US011401782B2

(12) United States Patent
Batarseh et al.

(10) Patent No.: US 11,401,782 B2
(45) Date of Patent: *Aug. 2, 2022

(54) IN-SITU HEATING FLUIDS WITH ELECTROMAGNETIC RADIATION

(71) Applicant: Saudi Arabian Oil Company, Dhahran (SA)

(72) Inventors: Sameeh Issa Batarseh, Dhahran (SA); Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/080,646

(22) Filed: Oct. 26, 2020

(65) Prior Publication Data

US 2021/0054721 A1 Feb. 25, 2021

Related U.S. Application Data

(63) Continuation of application No. 16/272,807, filed on Feb. 11, 2019, now Pat. No. 10,830,017, which is a (Continued)

(51) Int. Cl.
*E21B 36/04* (2006.01)
*E21B 43/24* (2006.01)
(Continued)

(52) U.S. Cl.
CPC ..... *E21B 36/04* (2013.01); *E21B 17/18* (2013.01); *E21B 36/005* (2013.01);
(Continued)

(58) Field of Classification Search
CPC ..... E21B 36/04; E21B 36/005; E21B 17/18; E21B 43/2401; E21B 43/38
See application file for complete search history.

(56) References Cited

U.S. PATENT DOCUMENTS 3,228,471 A * 1/1966 Shook ..... E21B 36/005 166/256
4,819,723 A 4/1989 Whitfill
(Continued)

FOREIGN PATENT DOCUMENTS

WO WO 2013155061 10/2013
WO WO 2014171960 10/2014
(Continued)

OTHER PUBLICATIONS

PCT International Search Report issued in International Application No. PCT/US2018/045532 dated Oct. 26, 2018, 13 pages.

*Primary Examiner* — Dany E Akakpo
(74) *Attorney, Agent, or Firm* — Fish & Richardson P.C.

(57) ABSTRACT

Methods, apparatus and systems for in-situ heating fluids with electromagnetic radiation are provided. An example tool includes a housing operable to receive a fluid flowed through a flow line and a heater positioned within the housing. The heater includes a number of tubular members configured to receive portions of the fluid and an electromagnetic heating assembly positioned around the tubular members and configured to generate electromagnetic radiation transmitted to heat the tubular members. The heated tubular members can heat the portions of the fluid to break emulsion in the fluid. Upstream the heater, the tool can include a homogenizer operable to mix the fluid to obtain a homogenous fluid and a stabilizer operable to stabilize the fluid to obtain a linear flow. Downstream the heater, the tool can include a separator operable to separate lighter components from heavier components in the fluid after the emulsion breakage.

15 Claims, 5 Drawing Sheets

Related U.S. Application Data continuation of application No. 15/671,720, filed on Aug. 8, 2017, now Pat. No. 10,669,814.

(51) Int. Cl.

| | |
|---|---|
| ***E21B 17/18*** | (2006.01) |
| ***E21B 36/00*** | (2006.01) |
| ***E21B 43/38*** | (2006.01) |
| ***E21B 17/10*** | (2006.01) |

(52) U.S. Cl.

CPC ..... *E21B 43/2401* (2013.01); *E21B 43/38* (2013.01); *E21B 17/1078* (2013.01)

(56) References Cited

U.S. PATENT DOCUMENTS

| | | | |
|---|---|---|---|
| 4,853,507 | A | 8/1989 | Samardzija |
| 5,072,087 | A | 12/1991 | Apte |
| 6,056,882 | A | 5/2000 | Scalliet |
| 6,077,400 | A | 6/2000 | Kartchner |
| 6,214,236 | B1 | 4/2001 | Scalliet |
| 7,486,248 | B2 | 2/2009 | Halek et al. |
| 7,775,961 | B2 | 8/2010 | Meikrantz |
| 7,891,416 | B2 | 2/2011 | Pankratz et al. |
| 8,431,015 | B2 | 4/2013 | Banerjee |
| 8,586,898 | B2 | 11/2013 | Novak |
| 8,925,627 | B2 | 1/2015 | Tupper et al. |
| 9,322,255 | B2 | 4/2016 | Diehl et al. |
| 2003/0098605 | A1 | 5/2003 | Vinegar |
| 2009/0071646 | A1 | 3/2009 | Pankratz et al. |
| 2012/0312538 | A1 | 12/2012 | Koolman |
| 2013/0213795 | A1 | 8/2013 | Strohm et al. |
| 2014/0374101 | A1* | 12/2014 | Orrego ..... E21B 36/005 166/302 |
| 2015/0275636 | A1 | 10/2015 | Diehl et al. |
| 2015/0308248 | A1 | 10/2015 | Diehl et al. |

FOREIGN PATENT DOCUMENTS

| | | |
|---|---|---|
| WO | WO 2014189533 | 11/2014 |
| WO | WO 2015140636 | 9/2015 |
| WO | WO 2015142330 | 9/2015 |

* cited by examiner

IN-SITU HEATING FLUIDS WITH ELECTROMAGNETIC RADIATION

CROSS-REFERENCE TO RELATED APPLICATION(S)

This application is a continuation of U.S. patent application Ser. No. 16/272,807, filed on Feb. 11, 2019, which is a continuation of and claims the benefit of priority to U.S. patent application Ser. No. 15/671,720, filed on Aug. 8, 2017, now U.S. Pat. No. 10,669,814, issued on Jun. 2, 2020, the contents of which are hereby incorporated by reference.

TECHNICAL FIELD

This specification relates to heating fluids, particularly for breaking emulsions in hydrocarbon systems.

BACKGROUND

Tight emulsions are frequently present in hydrocarbon systems either in well flow lines or in pipe lines. The presence of emulsions requires specific handling such as a need for increasing pumping power, accurate rate metering and produced fluid treatment. Oil field related emulsions can include water-in-oil emulsions with drop distribution sizes above the tenth of a micrometer, and these emulsions also need a specific treatment. In some cases, the emulsions can be treated by chemical de-emulsifiers, which may be costly and operationally challenging.

SUMMARY

The present specification describes methods, apparatus, and systems for in-situ heating fluids with electromagnetic radiation, particularly for breaking emulsions in hydrocarbon systems.

One aspect of the present specification features a well tool including: a plurality of tubular members arranged in an array and configured to be positioned in a flow line positioned downhole within a wellbore, each of the plurality of tubular members configured to receive a respective portion of a well fluid flowed through the flow line; and an electromagnetic (EM) heating assembly configured to be positioned around the plurality of tubular members, the EM heating assembly configured to generate EM radiation transmitted to the plurality of tubular members, the plurality of tubular members being heated by the transmitted EM radiation, the plurality of heated tubular members heating the respective portions of the well fluid flowed through the plurality of tubular members.

In the array, longitudinal axes of the plurality of tubular members can be offset from each other and are parallel to a longitudinal axis of the flow line. An outer contour of the array can be substantially cylindrical in cross-section. The outer contour of the array can be sized to fit within an inner volume of the flowline.

The plurality of tubular members can be arranged side-by-side within the flow line and are substantially parallel to each other. The plurality of tubular members can be of substantially equal length, and wherein axial ends of the plurality of tubular members are aligned. Space between the axial ends of the plurality of tubular members can be filled with a material that is impermeable to the well fluid.

In some implementations, the EM heating assembly includes a plurality of arcuate heating elements arranged end-to-end to have a substantially cylindrical cross-section that defines a hollow space, and the plurality of tubular members arranged in the array are positioned within the hollow space. Each arcuate heating element can be configured to generate EM radiation. An outer diameter of the substantially cylindrical cross-section can be smaller than an inner diameter of the flow line. Each arcuate heating element can be attached to an inner surface of the flow line.

Another aspect of the present specification features a downhole tool for treating well fluids flowed through a flow line positioned downhole within a wellbore. The downhole tool includes: a housing positioned downhole within the wellbore and operable to receive a well fluid flowed through the flow line; and a heater positioned within the housing, including: a plurality of tubular members arranged in an array and configured to be positioned within the housing, each of the plurality of tubular members configured to receive a respective portion of the well fluid, and an electromagnetic (EM) heating assembly configured to be positioned around the plurality of tubular members, the EM heating assembly configured to generate EM radiation transmitted to the plurality of tubular members, the plurality of tubular members being heated by the transmitted EM radiation, the plurality of heated tubular members heating the respective portions of the well fluid flowed through the plurality of tubular members.

The well fluid can include emulsion, and the plurality of heated tubular members can be operable to heat the respective portions of the well fluid to break the emulsion in the respective portions of the well fluid.

The downhole tool can further includes a centralizer coupled to the housing and operable to centralize the housing with respect to the flow line. The downhole tool can also include a homogenizer arranged upstream the heater within the housing and operable to mix the well fluid to obtain a homogenous and uniform fluid before the well fluid is flowed through the heater. The downhole can further include a stabilizer arranged upstream the heater within the housing and operable to stabilize the well fluid to obtain a linear and steady flow before the well fluid is flowed through the heater.

In some examples, the well fluid includes lighter components and heavier components, and the downhole tool can further include a separator arranged downstream the heater within the housing and operable to separate the lighter components from the heavier components in the well fluid after the well fluid is flowed through the heater.

A further aspect of the present specification features a method of treating well fluids flowed through a flow line within a wellbore positioned below a terranean surface. The method includes: receiving, in the flow line, a well fluid to flow into a plurality of tubular members arranged in an array and positioned within the flow line; flowing respective portions of the well fluid through the plurality of tubular members; while the respective portions of the well fluid are flowed through the plurality of tubular members: generating electromagnetic (EM) radiation by an EM heating assembly positioned within the flow line and around the plurality of tubular members; transmitting, by the EM heating assembly, the EM radiation to the plurality of tubular members, the plurality of tubular members being heated by the transmitted EM radiation; and heating, by the plurality of heated tubular members, the respective portions of the well fluid flowed through the plurality of heated tubular members.

The method can further include: before flowing the respective portions of the well fluid through the plurality of tubular members, mixing the well fluid to obtain a homogenous and uniform fluid; and stabilizing the well fluid to obtain a linear and steady flow.

In some cases, the well fluid includes lighter components and heavier components, and the method can further include: after heating the respective portions of the well fluid flowed through the plurality of tubular members, separating the lighter components from the heavier components in the well fluid.

Note that the term "flow line" herein can be any conduit for a fluid to flow. In some examples, the flow line is a pipeline, a string or a tubing positioned in a wellbore. In some examples, the flow line is a pipe or a tube positioned above a terranean surface.

The details of one or more implementations of the subject matter of this specification are set forth in the accompanying drawings and associated description. Other features, aspects, and advantages of the subject matter will become apparent from the description, the drawings, and the claims.

DETAILED DESCRIPTION

Figure 1:
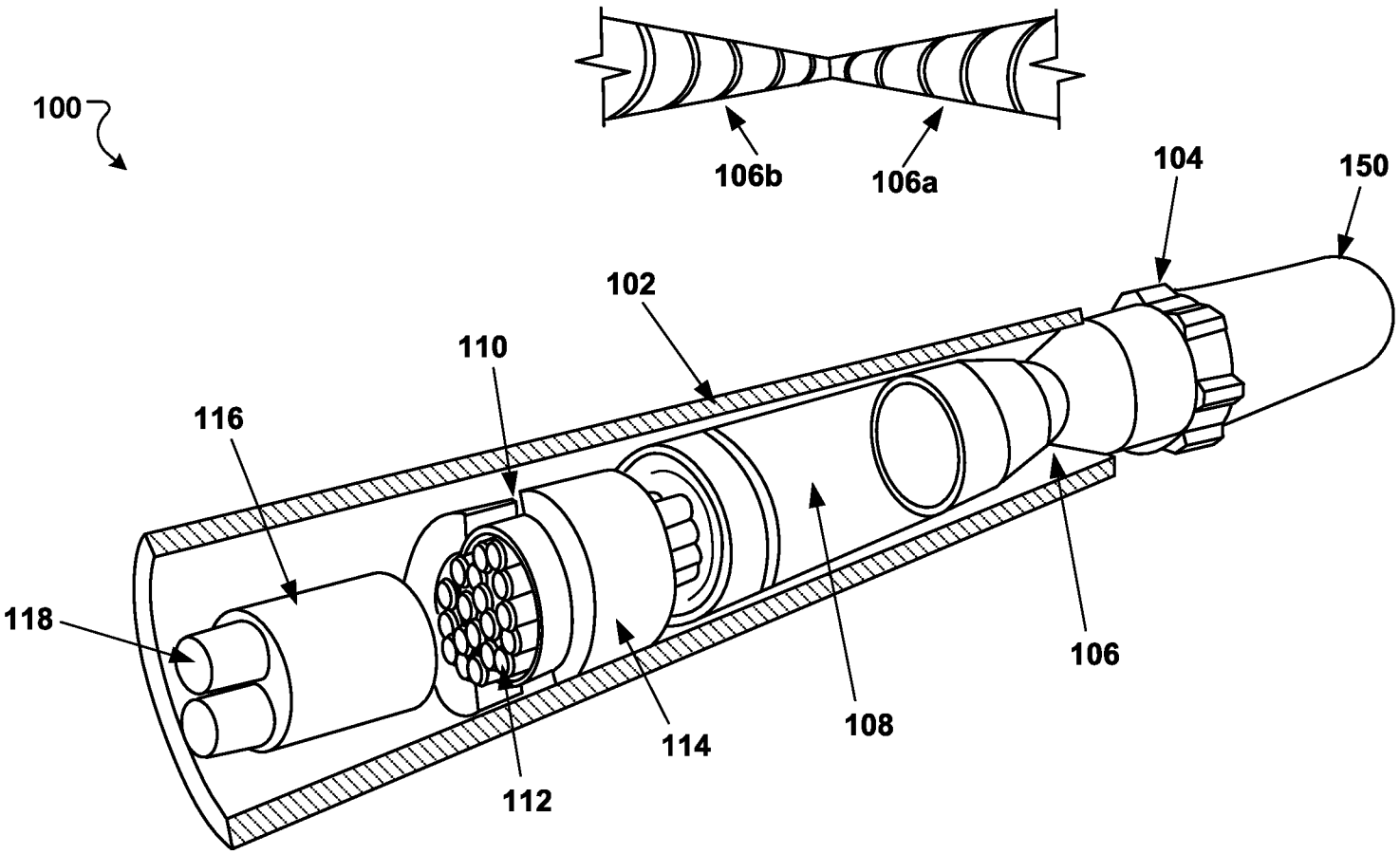
FIG. 1 is a schematic diagram illustrating example apparatus with an in-situ heater.

Heat can be used to break emulsion in a fluid by reducing a viscosity of the fluid, favoring droplet collision, and hence enhancing coalescence. Heat treatment can also help quickly breaking a film formed around a water droplet in the emulsion due to a presence of impurities. Some systems have used microwave (MW) radiation to directly interact with fluids for breaking emulsions, however, these systems are costly and have low operation efficiency.

Implementations of the present specification provide methods, apparatus and systems for in-situ heating fluids with electromagnetic (EM) radiation, such as radio frequency (RF) radiation or microwave (MW) radiation. As an example, the present specification provides a tool for facilitating tight emulsion breaking of a fluid in a wellbore flow line using in-situ microwave heating of ceramic tubes. The fluid can be divided into multiple streams that flow into multiple ceramic tubes placed inside a main pipeline. Microwave heating elements can be placed around the ceramic tubes and inside the main pipeline. The ceramic tubes can be fabricated from special ceramic materials. These ceramic materials can have unique heating properties and can be heated to very high controllable temperatures using MW radiation. For example, the temperature of the ceramic materials when exposed to MW radiation, can reach up to 1000° C. The high temperatures allow fast and easy breakage of tight emulsions. In some implementations, before the fluid flows through the ceramic tubes for emulsion breakage, a homogenizer can be used to mix the fluid to obtain a homogenous and uniform flow, and a stabilizer can be used to get a linear and steady flow. After the emulsion breakage, in some implementations, the fluid can pass through a fluid separator to separate lighter components from heavier components in the fluid to different separation outlets. Note that the example above is given in the context of a wellbore within which the tool is placed, but implementations in which the tool is used in flow lines above the surface are also possible. For example, the tool can be used for refining crude oil.

The technology presented herein provides in-situ direct heating of tight emulsions with microwave heating apparatus. The technology provides a unique combination of special ceramic material and microwaves, which can provide controllable temperatures for efficient emulsion breakage and greatly reduce the energy required to break the emulsion, for example, compared to using MW radiation to directly heat a fluid for emulsion breakage. The technology also reduces the cost of breaking emulsions, eliminating the need for expensive chemicals and related operational precautions, as well as helping in breaking the emulsions in-line and with minimal intervention. The technology enables to provide an integrated tool, which, in some implementations, includes: a) a homogenizer to mix the fluid, b) a stabilizer to stabilize the fluid, c) MW heating sources and ceramic tubes to divide and distribute the fluid for heat treatment, and d) a separator to separate the fluid. The technology also enables accurate metering and can be applied for multiphase metering. This technology can be applied in any suitable applications, for example, refining unconventional resources such as heavy oil.

FIG. 1 is a schematic diagram illustrating an example tool 100 with an in-situ heater 110 for fluid treatment. In some implementations, the tool 100 is used as a downhole tool positioned within a wellbore under a terranean surface. The downhole tool can be deployed downhole to be positioned within a pipeline, a string, or a tubing in the wellbore. In some implementations, the tool 100 is used as a fluid treatment tool above the terranean surface. For example, the tool 100 can be used for oil refinery.

A fluid, for example, a well fluid, can be flowed through a flow line 150, for example, by a pump. The fluid can include a hydrocarbon fluid, for example, crude oil, heavy oil, or bitumen. The fluid can have a high viscosity. In some cases, the fluid includes emulsion, for example, hydrocarbon and water emulsion or oil and water emulsion. In a particular example, the fluid includes emulsified mixture of oils, waxes, tars, salt and mineral laden water, fine sands and mineral particulates. The tool 100 is configured to treat the fluid, for example, to break the emulsion in the fluid, to reduce the viscosity of the fluid, to separate different components in the fluid, to visbreaking the fluid, or any combinations of them.

The tool 100 can include a housing 102 configured to receive the fluid flowed through the flow line 150. The housing 102 can be a cylindrical tube that defines a hollow space for holding multiple components. The housing 102 can include an inlet for receiving the fluid from the flow line 150 and an outlet for outputting the fluid treated by the tool 100. In some implementations, the tool 100 is a downhole tool positioned in a wellbore, and the housing 102 can be positioned within the wellbore.

The fluid passes (or is flowed) through the heater 110 positioned within the housing 102. The heater 110 (discussed in more detail with reference to FIGS. 3A-3B) includes a number of tubular members 112 arranged in an array and configured to be positioned within the housing 102. Each tubular member 112 defines a hollow space and is configured to receive a respective portion of the fluid.

The heater 110 also includes an electromagnetic (EM) heating assembly positioned around the tubular members. The EM heating assembly is configured to generate EM radiation which is transmitted to the tubular members. The tubular members are heated by the EM radiation transmitted, and are thus able to heat the respective portions of the fluid flowed through the tubular members.

In some implementations, the EM heating assembly includes microwave (MW) sources 114 configured to generate MW radiation, and the tubular members 112 include ceramic tubes (or pipes). As discussed later in FIGS. 3A-3B, the ceramic tubes can be made of special ceramic materials which serve as effective heat sources to absorb MW radiation, depending on a frequency of the MW radiation. The ceramic tubes can be heated by the MW radiation to reach elevated temperatures, for example, to 1000° C. The temperature of the ceramic tubes can be controllable, for example, by an energy level of the MW radiation.

Figure 2:
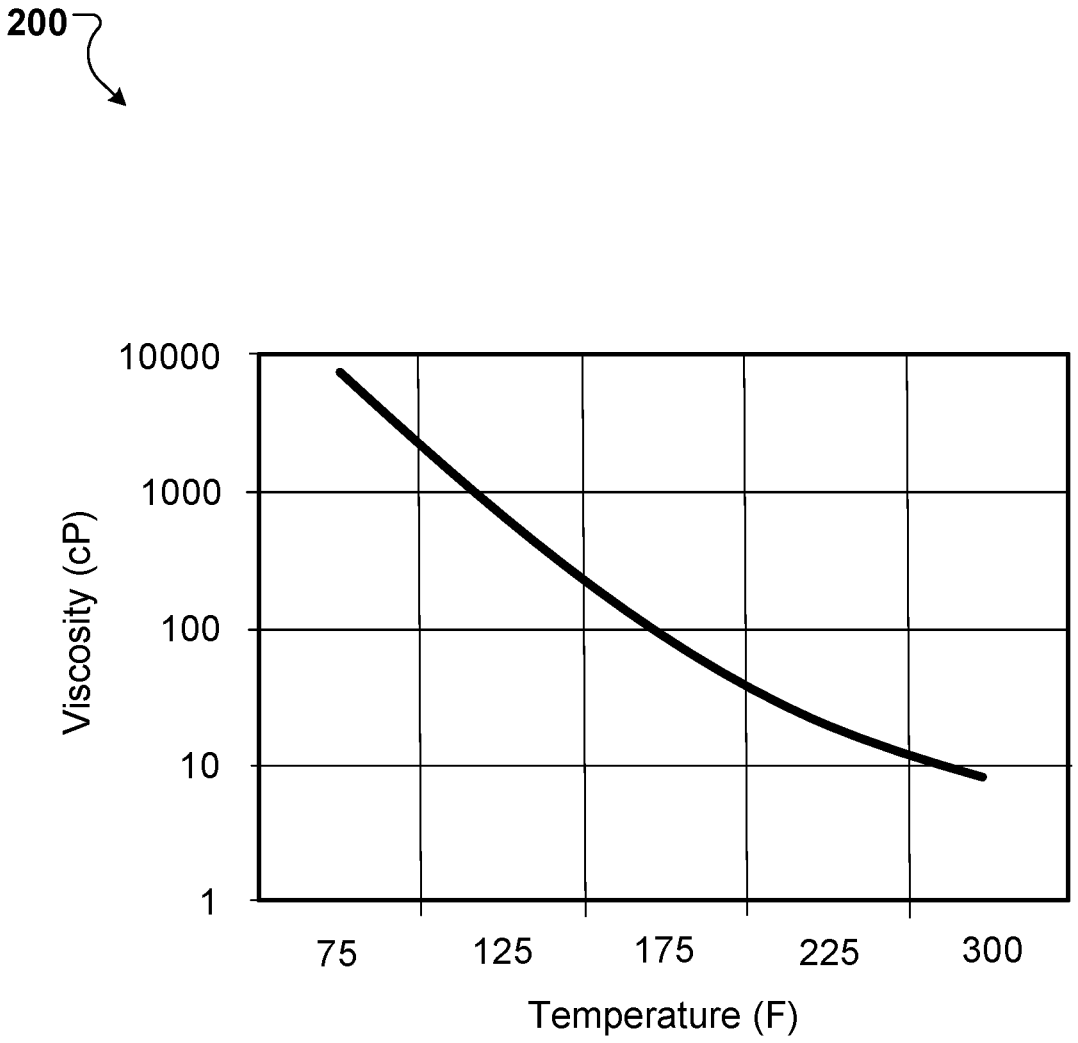
FIG. 2 is a diagram showing an example relationship between fluid viscosity and temperature.

FIG. 2 shows a diagram 200 of an example relationship between fluid viscosity and temperature. When the temperature of the fluid increases, the viscosity of the fluid decreases accordingly. For example, when the temperature of the fluid is at 100° F., the viscosity of the fluid is above 1000 centipoise (cP); when the temperature of the fluid is at 250° F., the viscosity of the fluid is about 10 cP.

Referring back to FIG. 1, the heated tubular members 112 heat the fluid flowed through the tubular members 112. Thus, the fluid can have a reduced viscosity after being heated by the heater 110. In some cases, the heater 110 can heat the fluid to a temperature high enough to break the emulsion in the fluid by reducing the viscosity of the fluid, favoring droplet collision, and hence enhancing coalescence. The fluid, after the emulsion breakage, can include the separated emulsion components. The fluid can include lighter components with smaller densities and heavier components with larger densities. For example, the oil and water emulsion can be broken into constituent oil and water.

In some implementations, the tool 100 includes a centralizer 104 coupled to the housing 102 (for example, to the inlet of the housing 102) and an upstream part of the flow line 150. The centralizer 104 is operable to centralize the housing 102 (or the tool 100) with respect to the flow line 150, such that the tool 100 (or the housing 102) receives an accurate and consistent flow of the fluid. The centralizer 104 can be positioned inside the housing 102 or outside of the housing 102.

The fluid can enter the tool 100 at different flow rates and the fluid can have a heterogeneous flow. In some implementations, the tool 100 includes a homogenizer (or a mixer) 106 arranged upstream the heater 110 within the housing 102. The homogenizer 106 is configured to mix the fluid to ensure evenly fluid distribution and homogeneity, for example, to obtain a homogenous and uniform fluid before the fluid is flowed through the heater 110.

In some examples, the homogenizer 106 includes a pair of vortexes having a first vortex 106*a* and a second, sequential vortex 106*b*, as illustrated in FIG. 1. The first vortex 106*a* defines a first hollow space with a decreasing inner diameter and the second vortex 106*b* defines a second hollow space with an increasing inner diameter. The first vortex 106*a* and the second vortex 106*b* are joint at a central portion having a smallest diameter. The homogenizer 106 receives the fluid at an inlet of the first vortex 106*a* and outputs the fluid at an outlet of the second vortex 106*b*. In some cases, the homogenizer 106 can include multiple pairs of vortexes to mix the fluid.

The tool 100 can also include a stabilizer 108 arranged upstream the heater 110 within the housing 102. The stabilizer 108 is operable to stabilize the fluid to control the fluid flow rate at a linear steady state, for example, to obtain a linear and steady flow before the fluid is flowed through the heater 110. The stabilizer 108 can be arranged downstream the homogenizer 106 within the housing 102, as illustrated in FIG. 1. The stabilizer 108 can be also arranged upstream the homogenizer 106 within the housing 102.

In some implementations, the tool 100 includes a separator 116 arranged downstream the heater 110 within the housing 102. The separator 116 is configured to separate lighter components from heavier components to different separation outlets 118. When the fluid is flowed through the separator 116 after the heater 110, the lighter components and the heavier components in the fluid can be separated to the different separation outlets 118.

Figure 3A:
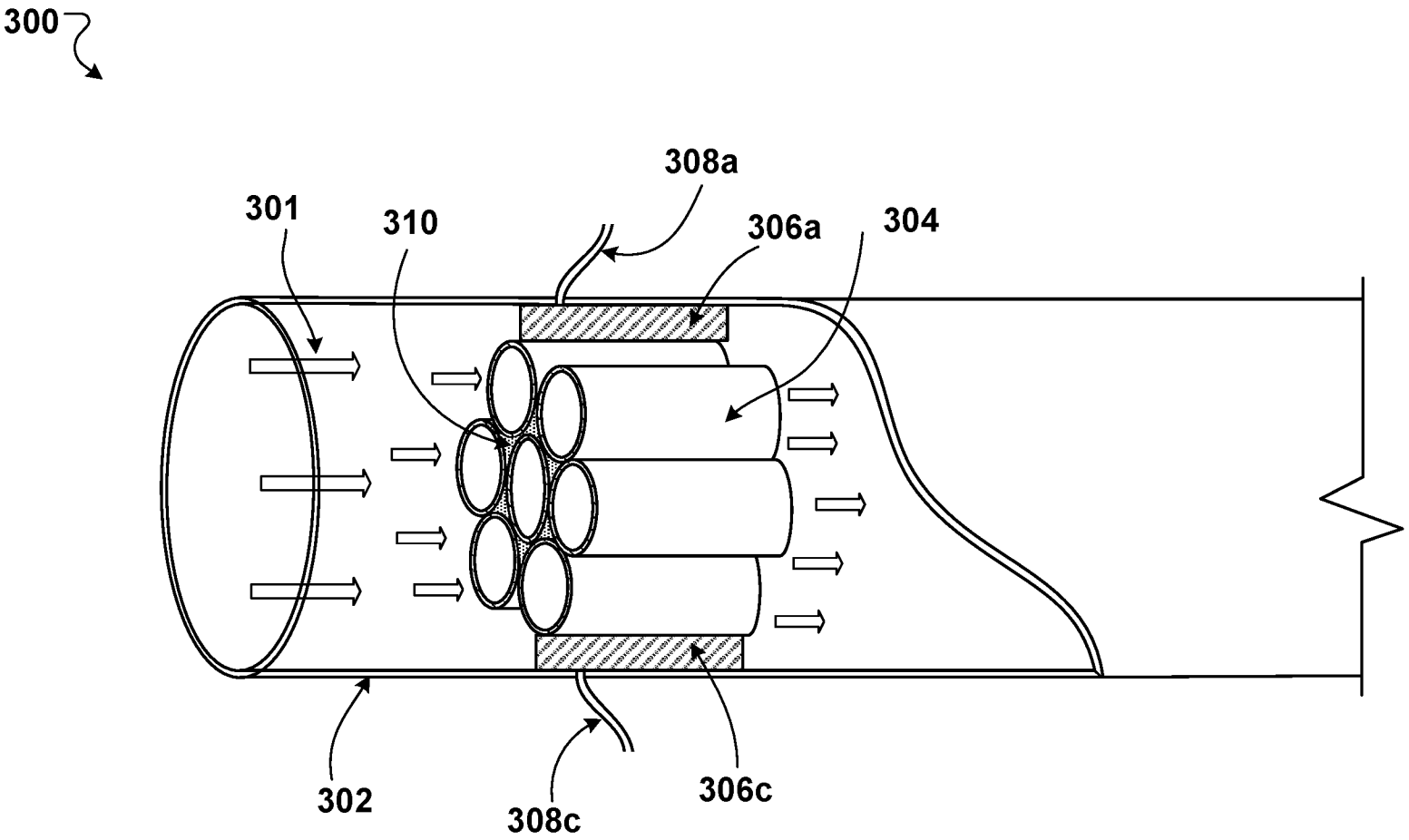
FIG. 3A is a schematic diagram illustrating an example in-situ heater for fluid heating.
Figure 3B:
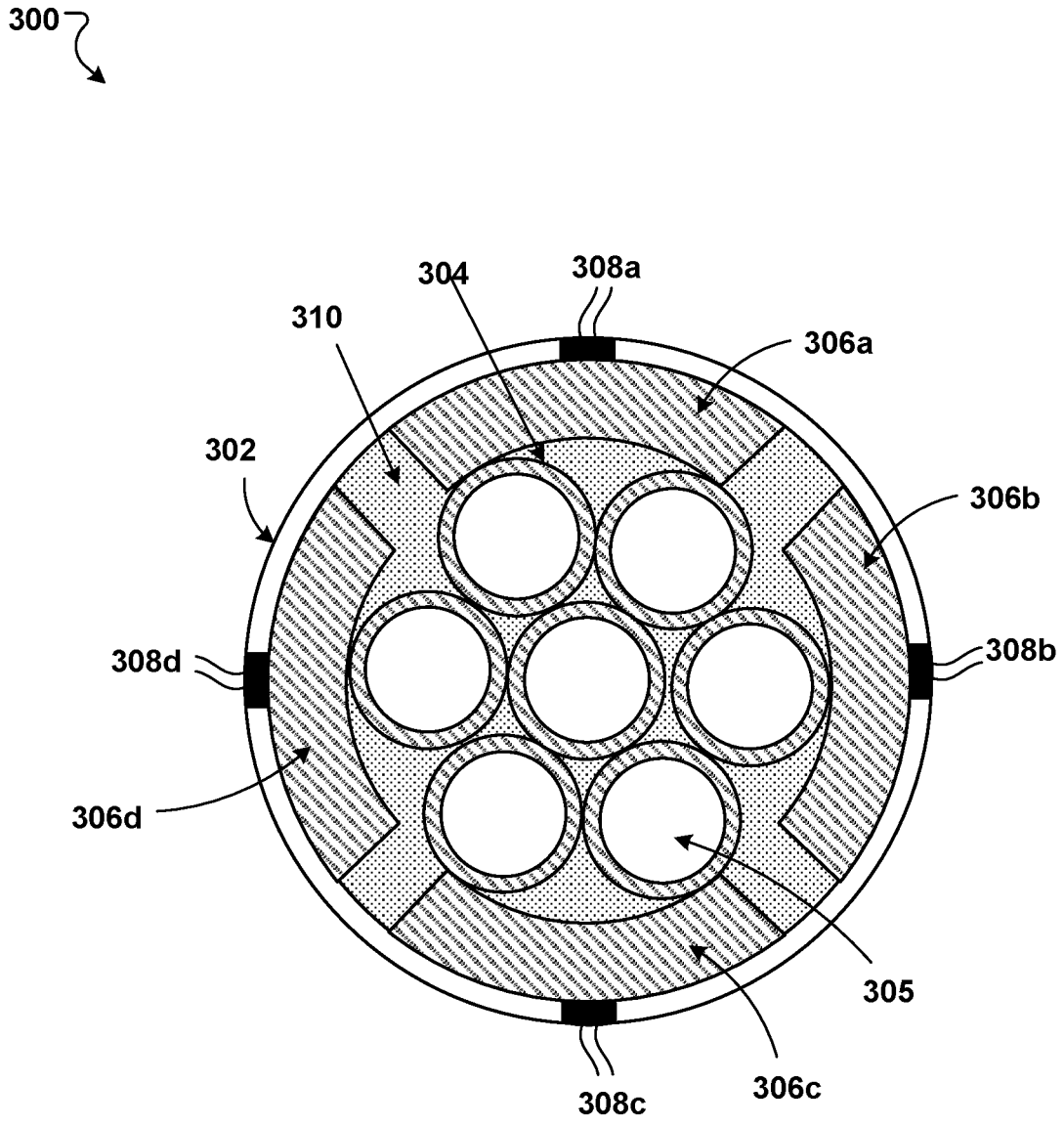
FIG. 3B is a cross-sectional view of the heater of FIG. 3A.

FIGS. 3A-3B show an example in-situ heater 300 for fluid heating. The heater 300 is configured to heat a fluid flowed (or flowing) along a flow direction 301 through the heater 300. The heater 300 can also heat a static fluid contained within the heater 300.

FIG. 3A is a longitudinal cross-sectional view of the heater 300, and FIG. 3B is a transverse cross-sectional view of the heater 300. The heater 300 can be used as the heater 110 in the tool 100 of FIG. 1. The heater 300 can be also used to heat any suitable fluid in any other suitable applications or scenarios. For example, the heater 300 can be arranged in a wellbore as a downhole tool or above a terranean surface for refining crude oil.

In some implementations, the heater 300 includes a number of tubular members 304 arranged in an array. In the array of the tubular members 304, longitudinal axes of the tubular members 304 can be offset from each other and are parallel to a longitudinal axis of the flow line 302. An outer contour of the array of tubular members 304 can be configured to be similar to an inner contour of the flow line 302. For example, the flow line 302 can be a cylindrical tube, and the outer contour of the array of tubular members 304 can be substantially cylindrical in cross-section. The outer contour of the array can be sized to fit within an inner volume of the flow line 302. Each tubular member 304 defines a flow area 305 and is configured to receive a respective portion of the fluid flowed through the flow line 302. The fluid flowed through the flow line 302 can be divided among the number of tubular members 304, for example, to allow for minimal pressure loss. Sizes (for example, inner diameters) of the tubular members 304 can be adjusted such that the fluid is equally divided into the number of the tubular members 304. In some cases, the inner diameters of the tubular members 304 are configured such that heat from the tubular members 304 can heat the fluid in its entirety. In some cases, lengths of the tubular members 304 are configured such that it is sufficient to heat the fluid within the tubular members 304 to a particular temperature before the fluid exits the tubular members 304.

The number of the tubular members, the sizes (for example, the inner diameters) of the tubular members, or both, can be determined by the inner volume of the flow line 302, a fluid volume passing through the flow line 302, a fluid type or viscosity, or any combinations of them. For example, if the fluid volume is smaller, the number of the tubular members 304 can be less or the sizes of the tubular members 304 can be smaller. If the fluid is less viscous, a smaller number of larger tubular members can be used instead of a larger number of smaller tubular members.

The tubular members 304 can be arranged side-by-side within the flow line 302 and are substantially parallel to each other. In some cases, there can be substantially no gap between the tubular members 304. In some cases, the tubular members 304 are configured such that there is a small gap or space between them, such that, when the tubular members

304 are heated up to a high temperature, the gap or space between the tubular members 304 can prevent them from breaking down due to thermal expansions.

The tubular members 304 can be of a substantially equal length, and axial ends of the tubular members 304 can be aligned to each other. Each tubular member 304 includes an inlet and an outlet along the flow direction 301. In some implementations, space between axial ends at the inlets of the tubular members 304 is filled with a filling material 310 that is impermeable to the fluid. The filling material 310 can include an epoxy, an insulating material such as glass fiber or carbon fiber, or any material that is heat isolating. The filling material 310 can prevent the fluid to flow between the tubular members 304, for example, to avoid irregular non-uniform flow. The filling material 310 can be transparent to EM radiation used by the heater 300. The filling material 310 can also be resistant to high temperatures. In some implementations, space between axial ends at the outlets of the tubular members 304 can be also filled with the filling material 310 impermeable to the fluid. The filling materials 310 can prevent the fluid that has flowed out of the tubular members 304 to flow back into any gap or space between the tubular members 304.

The heater 300 includes an electromagnetic (EM) heating assembly configured to be positioned around the array of the tubular members 304. The EM heating assembly is configured to generate EM radiation transmitted to the tubular members 304, such that the tubular members 304 can be heated by the EM radiation. As discussed later, a tubular member can be made of a material to readily absorb the generated EM radiation. Exposure of the tubular member to the EM radiation causes rotation in polar molecules of the material, which results in heat being generated. The heated tubular members 304 can then heat the respective portions of the fluid flowed through the heated tubular members 304.

In some implementations, the EM heating assembly of the heater 300 includes a number of heating elements 306*a*, 306*b*, 306*c*, 306*d*. The heating element 306*a*, 306*b*, 306*c*, or 306*d* can have an arcuate shape or any other suitable shape. The heating elements 306*a*, 306*b*, 306*c*, 306*d* can be arranged end-to-end to have a substantially cylindrical cross-section that defines a hollow space. An outer diameter of the substantially cylindrical cross-section of the heating element 306*a*, 306*b*, 306*c*, or 306*d* can be smaller than an inner diameter of the flow line 302. The heating elements 306*a*, 306*b*, 306*c*, 306*d* can be positioned inside the flow line 302, for example, to maximize heating effects. In some cases, each heating element can have an outer contour shaped to fit with an inner surface of the flow line 302 and can be attached (for example, by adhesive material) to the inner surface of the flow line 302.

In some cases, the array of the tubular members 304 can be positioned within the hollow space defined by the heating elements 306*a*, 306*b*, 306*c*, 306*d*. The outer contour of the array of the tubular members 304 can be sized to fit within the hollow space. In some cases, as shown in FIG. 3B, tubular members defining the outer contour 304 can be attached (for example, by adhesive material) to inner surfaces of the heating elements. Space between the tubular members, space between the heating elements, space between the tubular members and the heating elements, and space between the flow line and the heating elements and tubular members, can be filled with the filling materials 310, such that the tubular members 304 and the heating elements can be integrated and attached to the flow line 302.

Each heating element 306*a*, 306*b*, 306*c*, 306*d* can include a respective electrical connector 308*a*, 308*b*, 308*c*, 308*d* coupled to a power source and configured to generate EM radiation. The heating element 306*a*, 306*b*, 306*c*, or 306*d* can be an antenna that radiates EM waves and can include an electromagnetic coil such as an induction heating coil. An energy level of the generated EM radiation can be controlled by an output power from the power source supplied to the heating element 306*a*, 306*b*, 306*c*, or 306*d*.

One or more properties (including the number and the sizes) of the EM heating elements 306*a*, 306*b*, 306*c*, 306*d* can be determined based on one or more properties of the fluid flowed through the heater 300 including a fluid volume, type, and viscosity, and one or more properties of the tubular members 304 including a material of the tubular members 304, a configuration of the tubular members 304, and sizes (for example, inner diameters, lengths, and inner volumes) of the tubular members 304.

The material of the tubular member 304 can be determined based on a type of the fluid flowed through. For example, if the fluid is highly corrosive, the material can be non-corrosive. The material of the tubular member 304 can be also determined based on a pressure of the fluid flow. For example, if the fluid flow has a higher pressure, the strength of the material can be stronger.

EM absorption coefficients of materials depend on a frequency of EM radiation. The EM radiation can be radio frequency (RF) radiation with a frequency within a range of 3 KHz to 300 MHz, or microwave (MW) radiation with a frequency within a range of 300 MHz to 300 GHz. For example, aluminas and zirconia have larger absorption coefficients at higher microwave frequencies, while carbides have lower absorption coefficients at lower RF range. Thus, the material of the tubular members 304 can be determined (or selected) to have a high EM radiation absorption coefficient at an operating frequency of the EM radiation generated by the heating elements 306*a*, 306*b*, 306*c*, 306*d*. The material of the tubular members 304 can be any suitable effective heat absorption source (or a susceptor) to readily absorb the generated EM radiation. The material can include one of aluminas, silicon carbide, silicon/silicon carbide, carbon/graphite, zirconia, and molydisilicide.

In some examples, the heating element 306*a*, 306*b*, 306*c*, or 306*d* is a microwave (MW) source, and the operating frequency of the MW radiation is 2.45 GHz The tubular member 304 can be made of a ceramic material, for example, alumina. The ceramic material can have a high rate of heating absorption, e.g., excess of 50° C. per minute. The ceramic material can be heated up to 1000° C. when exposed to the MW radiation.

The temperature of the tubular member 304 can be controllable, for example, by controlling an energy level of the generated EM radiation. As noted above, the energy level of the EM radiation can be controlled by the output power from the power source supplied to the heating element 306. In some implementations, the heater 300 includes a control system that controls the output power of the power source. In some cases, the control system includes one or more temperature sensors operable to measure temperatures of the tubular members 304. Based on the measured temperatures of the tubular members 304, the control system can adjust the output power of the power source to adjust the energy level of the generated EM radiation. The output power of the power source can be adjusted by changing a magnitude of the output power or a duration of the output power. In some cases, the control system includes one or more temperature sensors operable to measure temperatures of the portions of the fluid flowing through the tubular members 304 or the fluid that has flowed out of the tubular members 304. Based on the measured temperatures of the fluid, the control system can adjust the output power of the power source to adjust the energy level of the generated EM radiation.

In some implementations, a separator, for example, the separator 116 of FIG. 1, is arranged downstream the heater 300 in the flow line 302. The control system can include a detector to detect separated components of the fluid from one or more outlets of the separator. For example, as discussed earlier, if the fluid includes oil and water emulsion, the fluid can be heated by the heater 300 to break the emulsion into constituent oil and water, which can be separated by the separator. If the detector detects no oil component at one of the outlets, it indicates that the temperature of the fluid is not high enough to break the emulsion, and the control system can increase the output power of the power source to increase the energy level of the generated EM radiation. In some cases, the heater 300 and the separator can be part of a tool, for example, the tool 100 of FIG. 1. The control system can be separated from the heater 300 and included in the tool.

Figure 4:
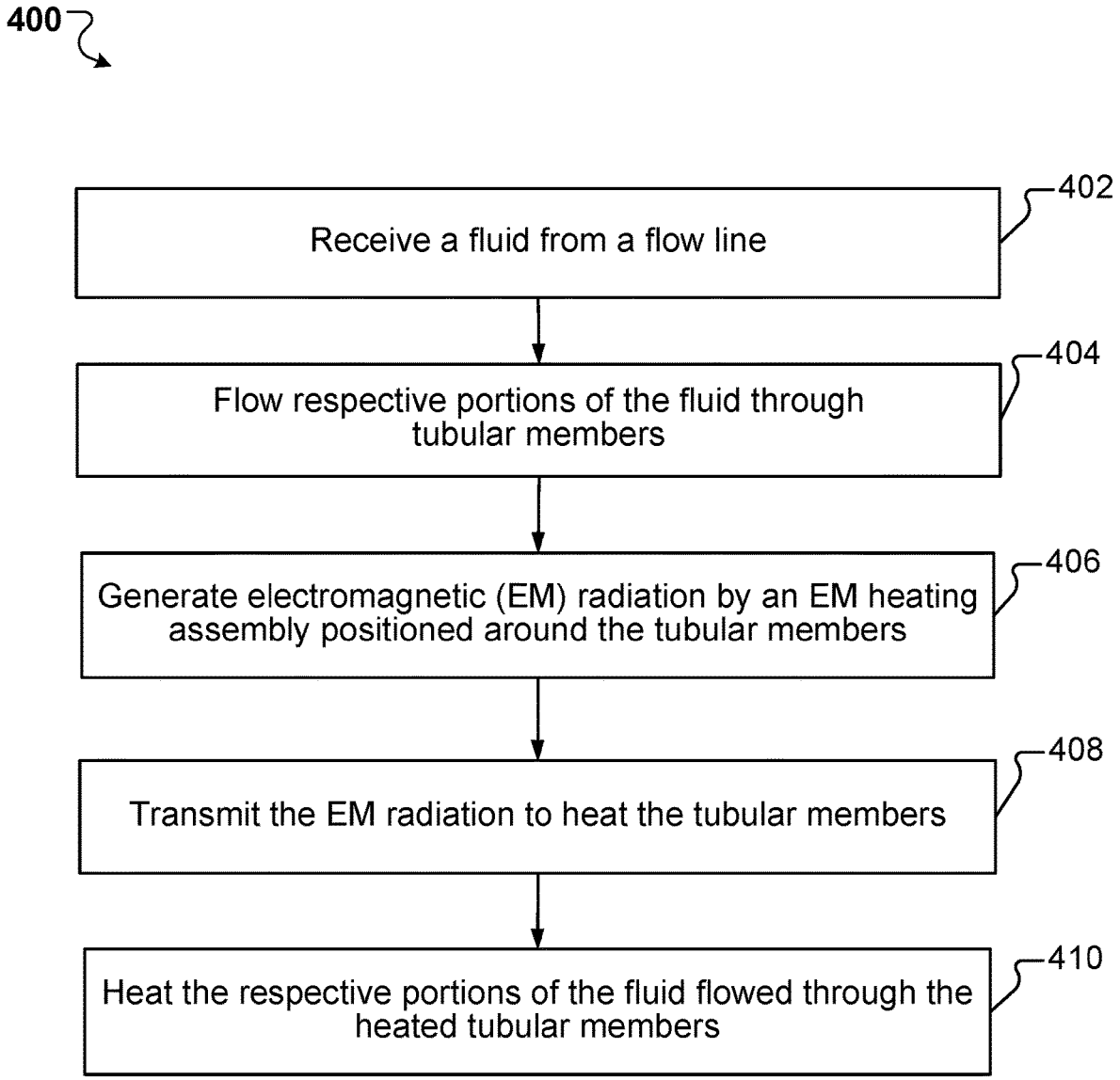
FIG. 4 is a flowchart of an example process of treating a fluid.

FIG. 4 is a flowchart of an example process 400 of treating a fluid. The process 400 can be performed by a tool, for example, the tool 100 of FIG. 1. The tool includes an in-situ heater, for example, the heater 110 of FIG. 1 or the heater 300 of FIGS. 3A-3B.

A fluid from a flow line is received (402). The fluid can be flowed through the flow line by a pump. The fluid can be a well fluid or any other type of fluid. The fluid can include emulsion, for example, hydrocarbon and water emulsion or oil and water emulsion. The fluid can have a high viscosity.

Respective portions of the fluid are flowed through a number of tubular members positioned in the flow line (404). The tubular members can be similar to the tubular members 112 of FIG. 1 or the tubular members 304 of FIGS. 3A-3B. Each tubular member is configured to receive a respective portion of the fluid. Space between the axial ends, particularly at inlets of the tubular members, can be filled with a material that is impermeable to the fluid, for example, the filling material 310 of FIGS. 3A-3B, such that the fluid is prevented from flowing between the tubular members.

While the respective portions of the fluid are flowed through the tubular members, electromagnetic (EM) radiation is generated by an EM heating assembly positioned around the tubular members (406). The EM heating assembly can include a number of heating elements, for example, the MW source 114 of FIG. 1 or the heating elements 306 of FIGS. 3A-3B.

The EM radiation is transmitted by the EM heating assembly to heat the tubular members (408). The tubular members are heated by the transmitted EM radiation, for example, to a high temperature. The temperature of the heated tubular members can be controlled by adjusting an energy level of the EM radiation, for example, up to 1000° C. The tubular members can be made of an EM subsector that is an effective heat source to absorb the EM radiation and has a high absorptive coefficient at a frequency of the generated EM radiation. In some examples, the EM radiation is a microwave radiation, and the tubular members are made of a ceramic material such as alumina.

The respective portions of the fluid flowed through the heated tubular members are heated (410). The heated tubular members can heat the portions of the fluid flowed through the tubular members to a high temperature. In some cases, the temperature of the heated fluid can be high enough to reduce the viscosity of the fluid, to break the emulsion in the fluid, or both.

In some cases, a centralizer is used to centralize the tool with respect to the flow line, such that an accurate and consistent flow of the fluid can be obtained by the tool. Before flowing the respective portions of the fluid through the tubular members, the fluid can be mixed, for example, by a homogenizer such as the homogenizer 106 of FIG. 1, to obtain a homogenous and uniform fluid. The fluid can be also stabilized, for example, by a stabilizer such as the stabilizer 108 of FIG. 1, to obtain a linear and steady flow.

In some cases, the fluid includes lighter components with smaller densities and heavier components with larger densities. After the respective portions of the fluid flowed through the tubular members are heated, the lighter components and the heavier components can be separated in the fluid. Then, the fluid can be flowed through a separator, for example, the separator 116 of FIG. 1, which can separate the lighter components and the heavier components into different outlets.

For simplicity and illustrative purposes, the present specification is described by referring mainly to examples thereof. In the above description, numerous specific details are set forth to provide a thorough understanding of the present specification. It will be readily apparent however, that the present specification may be practiced without limitation to these specific details. In other instances, some methods and structures have not been described in detail so as not to unnecessarily obscure the present specification.

The earlier provided description of example implementations does not define or constrain this specification. Other changes, substitutions, and alterations are also possible without departing from the spirit and scope of this specification. Accordingly, other embodiments are within the scope of the following claims.

The invention claimed is:

1. A well tool comprising:

a plurality of tubular members arranged in an array, each of the plurality of tubular members configured to receive a respective portion of a well fluid flowed through a flow line positioned downhole within a wellbore through which the well fluid is to be produced; and an electromagnetic (EM) heating assembly configured to be positioned around the plurality of tubular members, the EM heating assembly configured to generate EM radiation transmitted to the plurality of tubular members, the plurality of tubular members being heated by the transmitted EM radiation, the plurality of heated tubular members heating the respective portions of the well fluid flowed through the plurality of tubular members.

2. The well tool of claim 1, wherein, in the array, longitudinal axes of the plurality of tubular members are offset from each other and are parallel to a longitudinal axis of the flow line.

3. The well tool of claim 1, wherein an outer contour of the array is substantially cylindrical in cross-section.

4. The well tool of claim 3, wherein the outer contour of the array is sized to fit within an inner volume of the flowline.

5. The well tool of claim 1, wherein the plurality of tubular members are arranged side-by-side within the flow line and are substantially parallel to each other.

6. The well tool of claim 1, wherein the plurality of tubular members are of substantially equal length, and wherein axial ends of the plurality of tubular members are aligned.

7. The well tool of claim 6, wherein space between the axial ends of the plurality of tubular members is filled with a material that is impermeable to the produced well fluid.

8. A downhole tool for treating well fluids flowed through a flow line positioned downhole within a wellbore, the downhole tool comprising:

a housing positioned downhole within the wellbore and operable to receive a well fluid flowed through the flow line; and a heater positioned within the housing, including:

a plurality of tubular members arranged in an array and configured to be positioned within the housing, each of the plurality of tubular members configured to receive a respective portion of the well fluid, an electromagnetic (EM) heating assembly configured to be positioned around the plurality of tubular members, the EM heating assembly configured to generate EM radiation transmitted to the plurality of tubular members, the plurality of tubular members being heated by the transmitted EM radiation, the plurality of heated tubular members heating the respective portions of the well fluid flowed through the plurality of tubular members, and a homogenizer arranged upstream the heater and within the housing, and operable to mix the well fluid to obtain a homogenous and uniform fluid before the well fluid is flowed through the heater.

9. The downhole tool of claim 8, wherein the well fluid comprises emulsion, and wherein the plurality of heated tubular members are operable to heat the respective portions of the well fluid to break the emulsion in the respective portions of the well fluid.

10. The downhole tool of claim 8, further comprising:

a centralizer coupled to the housing and operable to centralize the housing with respect to the flow line.

11. The downhole tool of claim 8, further comprising:

a stabilizer arranged upstream the heater and within the housing, and operable to stabilize the well fluid to obtain a linear and steady flow before the well fluid is flowed through the heater.

12. The downhole tool of claim 8, wherein the well fluid comprises lighter components and heavier components, and wherein the downhole tool further comprises:

a separator arranged downstream the heater and within the housing, and operable to separate the lighter components from the heavier components in the well fluid after the well fluid is flowed through the heater.

13. A method of treating well fluids produced through a flow line within a wellbore positioned below a terranean surface, the method comprising:

receiving, in the flow line, a produced well fluid to flow into a plurality of tubular members arranged in an array and positioned within the flow line;

flowing respective portions of the produced well fluid through the plurality of tubular members;

while the respective portions of the produced well fluid are flowed through the plurality of tubular members:

generating electromagnetic (EM) radiation by an EM heating assembly positioned within the flow line and around the plurality of tubular members;

transmitting, by the EM heating assembly, the EM radiation to the plurality of tubular members, wherein the plurality of tubular members are heated by the transmitted EM radiation; and heating, by the plurality of heated tubular members, the respective portions of the well fluid flowed through the plurality of heated tubular members.

14. The method of claim 13, further comprising: before flowing the respective portions of the produced well fluid through the plurality of tubular members, mixing the produced well fluid to obtain a homogenous and uniform fluid; and stabilizing the produced well fluid to obtain a linear and steady flow.

15. The method of claim 14, wherein the produced well fluid includes lighter components and heavier components, and wherein the method further comprises: after heating the respective portions of the produced well fluid flowed through the plurality of tubular members, separating the lighter components from the heavier components in the produced well fluid.

* * * * *